United States Patent [19]
Bergh et al.
[11] 4,139,377
[45] Feb. 13, 1979

[54] FERRITIC CHROME STEELS OF HIGH NOTCHED BAR IMPACT STRENGTH AND METHOD OF MAKING SAME

[75] Inventors: Sigvard Bergh, Stockholm; Göran Gemmel; Christer Åslund, both of Torshälla, all of Sweden

[73] Assignee: Gränges Nyby AB, Sweden

[21] Appl. No.: 755,805

[22] Filed: Dec. 30, 1976

[30] Foreign Application Priority Data

Jan. 13, 1976 [SE] Sweden ..... 7600152

[51] Int. Cl.[2] ..... B22F 3/00

[52] U.S. Cl. ..... 75/243; 75/200; 75/246; 75/126 C; 75/126 D; 75/126 F; 75/126 J; 75/126 B; 75/128 A; 75/128 N; 75/128 G; 75/128 T; 75/128 W; 75/0.5 C

[58] Field of Search ..... 75/243, 246, 126 C, 75/126 D, 126 F, 126 J, 126 B, 128 A, 128 N, 128 G, 128 T, 128 W, 200, 0.5 C

[56] References Cited

U.S. PATENT DOCUMENTS

| | | | |
|---|---|---|---|
| 3,585,009 | 6/1971 | Harigaya | 75/126 C |
| 3,778,255 | 12/1973 | Ototani et al. | 75/128 W |
| 3,856,515 | 12/1974 | Brandis et al. | 75/128 W |
| 3,890,143 | 6/1975 | Skoglund et al. | 75/128 W |
| 3,932,175 | 1/1976 | Streicher | 75/126 C |
| 3,953,201 | 4/1976 | Wood et al. | 75/126 C |
| 3,957,544 | 5/1976 | Pinnow et al. | 75/126 C |
| 3,967,935 | 7/1976 | Frehn | 75/128 T |
| 3,993,445 | 11/1976 | Reen | 75/126 C |

OTHER PUBLICATIONS

Sands et al., *Powder Metallurgy* (1966) p. 121.

*Primary Examiner*—Brooks H. Hunt
*Attorney, Agent, or Firm*—Craig & Antonelli

[57] ABSTRACT

A method for producing stabilized ferritic stainless chrome steels which are distinguished in the welded state by high notched bar impact strength, wherein in powder-metallurginal manner by atomizing melts of the said chrome steels under argon a powder is produced which is pressed and agglomerated in known manner and that the pressed bodies are finally brought by hot or cold working into the desired semi-finished product form, preferably sheet form.

13 Claims, 2 Drawing Figures

Figure 1:
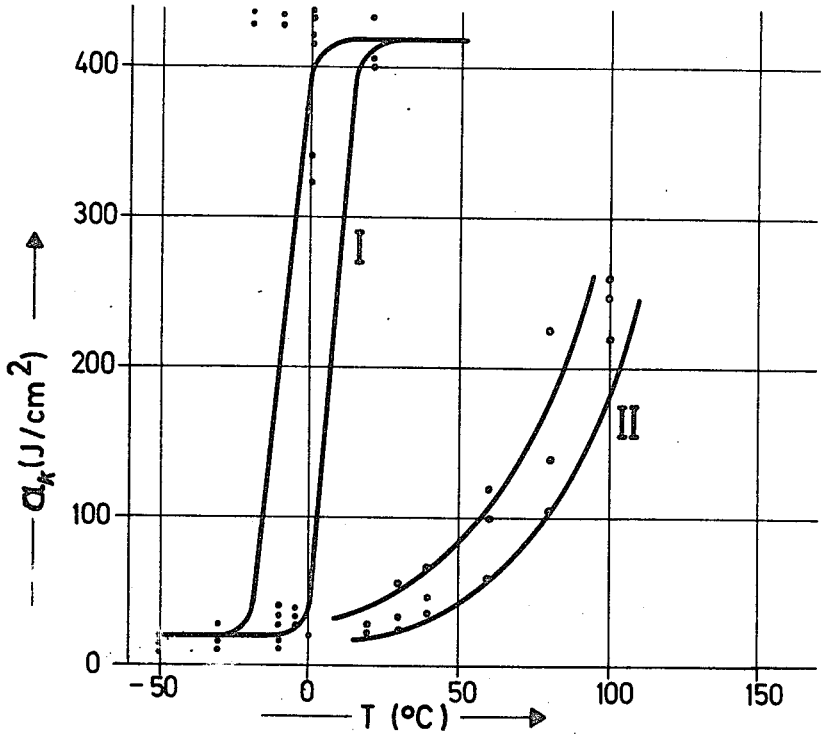

FERRITIC CHROME STEELS OF HIGH NOTCHED BAR IMPACT STRENGTH AND METHOD OF MAKING SAME

The present invention relates to a method for producing ferritic chrome steels of high notched bar impact strength in the welded state, chrome steel produced by the method and the use thereof for welded articles.

Ferritic chrome steels have become the centre of technical interest, particularly in the course of the last 10 years. They have been the subject of intensive research to impart to them properties which enable them to be used for welded structures as well. Greater knowledge on the mechanisms which influence the strength properties and the development of melt metallurgical processes used in the production of the steel have created certain requirements for imparting to these steels properties which meet the demands in the production of welded structures.

In this connection, reference is made in particular to welded structures which are in contact with hot water as described in German Offenlegungsschrift No. 2,318,506. By employing this new technical knowledge it has been possible to make structures which have acceptable mechanical properties and high resistance to corrosion even in the sensitive zone in the vicinity of the weld seam.

Nevertheless, there are still certain defects, in particular as regards the grain growth which can occur in the weld seam and in the vicinity thereof and is undesirable. As a rule, this leads to an increase of the so-called transition temperature, i.e. the temperature at which the notched bar impact strength of the steel drops greatly and the steel structure becomes brittle possibly even at room temperature.

On the basis of the new knowledge on the mechanism of grain growth, attempts have been made to find a method meeting the requirements necessary for providing the texture with a higher stability at the high temperatures which occur during welding and which led to the grain growth being excessive in ferritic steels.

The mobility of a grain boundary depends on the temperature and this can be expressed by an Arrhenius function. The same applies to the grain boundary diffusion to which the mobility is related. Both phenomena have an activation energy of the same order of magnitude. The grain boundary mobility or the migration of a grain boundary is prevented by the presence of soluble and insoluble particles in the basic composition of the steel. To make this prevention effective a large number of such particles must be present and they must be distributed so that the distance between them is relatively small. If the temperature is increased, in time a coalescence of the soluble particles occurs, i.e. certain particles grow at the expense of others, thus slowly weakening the restrictive effect on the grain boundary mobility and finally cancelling said effect altogether.

The intensive research work which forms the basis of this invention has shown that the finely dispersed precipitation of for example nitrides and carbides (and carbonitrides) of titanium obtained when a melt is rapidly cooled and reheated coalesces only very slowly. Welded structures which consist of a steel made by pressing and agglomerating of a powder produced by atomization of a chrome steel melt under argon tend, as has been found, far less to grain growth on heating to welding temperature. It has also been found that these welded articles are comparable in their corrosion and strength properties to steels of the same composition which have been made in conventional manner.

The resistance to grain growth which was thus obtained also results in strength properties in the vicinity of the weld seam which could not be obtained with steels made by the conventional methods. A measure of the improvement of the notched bar impact strength is the so-called transition temperature. The lower the latter the lesser the tendency to brittle fracture in welded structures.

As apparent from the example given below, the steel sheet made according to the invention by powder-metallurgical techniques and hot and cold working is as regards its notched bar impact strength appreciably superior to a material made in the hitherto conventional manner and having the same composition.

The invention is characterized by a method of producing stabilized ferritic stainless chrome steels which have the following composition with a high notched bar impact strength in the welded state:

max. 0.03% carbon,
max. 0.03% nitrogen,
10 to 30% chromium,
max. 5.0% nickel, preferably max. 0.5%,
max. 3.0% copper, preferably max. 0.2%,
max. 1.0% silicon,
max. 2.0% manganese,
0.5 to 4.0% molybdenum
and carbon and nitrogen-binding, i.e. stabilizing elements, in particular titanium but also niobium, tantalum, aluminium and others alone or together with titanium, whereby the contents must correspond at least to the stoichiometric ratio which is necessary for the formation of nitrides and carbides,
the remainder iron, with the provision that the starting material is made in a powder-metallurgical manner known per se, with the aid of a powder which has been obtained by atomizing stabilized ferritic stainless steels.

The production includes of course pressing and sintering the powder in a form of such dimensions and such density that the latter can in usual manner, i.e. by hot or cold treatment, be converted to a substantially dense and pore-free semi-finished product in the desired form, for example sheet form.

Hereinafter an example is given to illustrate and clarify the above remarks. However, the invention is not restricted to the production of semi-finished product from the aforementioned chrome steel for welded structures. It may cover all stabilized stainless chrome steels with ferritic structure.

17-PERCENT TITANIUM-STABILIZED CHROME MOLYBDENUM STEEL FOR HEAT EXCHANGERS

The powder was made by atomizing a melt of a chrome molybdenum steel under argon having the following composition:

0.03% carbon,
17% chromium,
2.4% molybdenum
0.6% titanium
0.03% nitrogen
0.02% oxygen
the remainder iron.

The powder-metallurgical method employed is described in Swedish patent application No. 7502944-7.

The powder was filled under vibration into a capsule of sheet iron which after the welding was compacted cold-isostatically with four kilobars. The capsule was then heated for 20 minutes to 1100° C. and pressed to rods of 15 mm diameter which were then rolled to sheets having a thickness of 5 mm. The capsule residues were removed by pickling.

After the recrystallization annealing at 900° C. (10 minutes) the material was very fine grain and had a grain size of 11 to 16 μm.

Material of the same composition but made in the usual manner in the form of cold-rolled sheet had a grain size of 30 to 60 μm.

To establish the tendency of the material to increase the grain size, annealings were carried out at 1100° C., 1200° C. and 1300° C. with a duration of 2, 5 and 30 minutes. No change in the grain size was detected in the steel made according to the invention after annealings at 1100° C. and 1200° C. After 2 minutes annealing at 1300° C. the grain size was 16 to 22 μm (individual grains 60 μm); after the extreme heat treatment of 30 minutes at 1300° C. the grain size at the surface was still 16 to 30 μm although coarse grains were detected in the middle.

A corresponding investigation with material made by conventional methods showed even after 2 minutes annealing at 1100° C. a grain size of 125 μm, after 2 minutes annealing at 1200° C. a size of 200 μm and at 1300° C. a size of 300 to 500 μm.

As apparent therefrom, the steel made by powder-metallurgical technique according to the invention has a particularly high stability with regard to grain growth.

It is advantageous to keep the particle amount to a low level in the grain boundaries and this is achieved by the present invention. The particles precipitated in the steel are mainly in the grain and thus do relatively little harm. Also of special importance is that the size of the particles in the grain boundary does not exceed a critical magnitude. For in the vicinity of large particles pores form which act as crack notches and thus reduce the notched bar impact strength. The low carbon and nitrogen contents and the critical cooling rate employed in the production of the powder result in a finely dispersed form of the precipitated particles which complies with the aforementioned requirement as regards critical particle size.

The utilization of the maximum possible strength of the material is thus obtained when using ferritic chrome steels made according to the present invention for welded structures when said material is made in powder-metallurgical manner. Under the temperature conditions obtaining, during the welding no appreciable increase in grain coarseness can occur. This results in the substantially greater industrial applicability and thus the high economy of the invention compared with welded products based on the production of steels with the same composition by conventional methods.

As a rule, the measure of the quality of the steel as regards its notched bar impact strength is the so-called transition temperature. At this temperature there is a transition of the notched bar impact strength from the high location via a sharp drop to the low location (cf. DIN 50 115). The temperature is often defined as that temperature at which the notched bar impact strength is 34 J/cm$^2$.

The transition temperatures of stabilized ferritic stainless chrome steels made in hitherto conventional manner are influenced by the heat treatment, the sample thickness and the grain size.

With large dimensions these steels have a transition temperature between 50° C. and 100° C. After a heat treatment at 1300° C. and after the welding the transition temperature increases by 25° C. to 50° C., i.e. to 75° C. to 150° C. The welded structures made from such a steel are therefore brittle at all these temperatures; they are thus dangerous in use at precisely the temperatures encountered in most of the fields of use occurring in practice.

The transition temperatures of the steels made according to the invention by powder-metallurgical techniques are in contrast considerably lower from the start than those of steels made by conventional methods. This is clearly apparent from the diagrams of FIGS. 1 and 2 which show comparative curves for the transition temperatures, the temperature T in ° C. being plotted on the abscissa and the notched bar impact strength $a_k$ in J/cm$^2$ on the ordinate.

Figure 2:
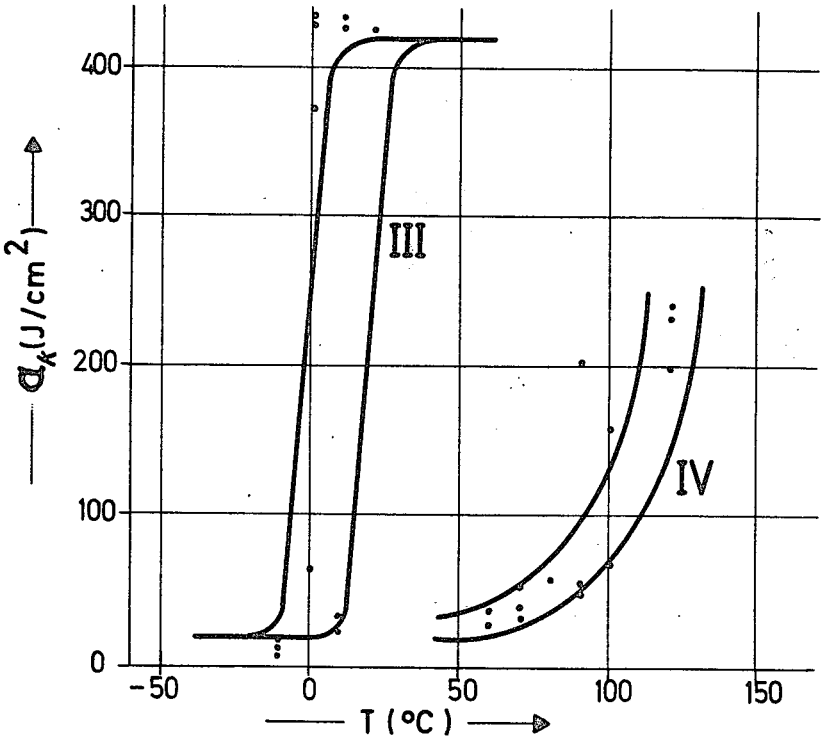

In FIGS. 1 and 2 the curves I, II, III and IV represent transition temperatures measured with 6.5 mm sheet, the curves I and III being those of ferritic chrome steels made according to the invention and the curves II and IV chrome steels made in conventional manner. The curves I and III illustrate the high and low levels of the notched bar impact strength for the steels made according to the invention by powder-metallurgical techniques.

The curves illustrated in FIG. 1 were determined for material which had been recrystallization annealed at 850° C. for 15 minutes and water cooled.

The transition temperature for the chrome steel according to the invention lies according to curve I between −20° and ±0° C. whereas the steel made in conventional manner has according to curve II a transition temperature about 40° C. higher, i.e. between +20° C. and +40° C.

In FIG. 2 the same chrome steels are compared but after a heat treatment at 1300° C. for 5 minutes. In spite of this temperature, the steel made according to the invention has in accordance with curve III a transition temperature which is still beneath the room temperature, i.e. −10° C. to +10° C. The steel made in usual manner has however, as shown by curve IV, a transition temperature which is 60° C. higher, i.e. between +50° C. and +70° C.

For the expert and in particular for the manufacturer of welded structures of ferritic chrome steels the method according to the invention means a considerable advance as well as the possibility of industrial use of material which was hitherto not suitable for welded articles.

What is claimed is:

1. A dense, pore-free ferritic chrome steel which is distinguished in the welded state by high notched bar impact strength, characterized in that it is produced from a powder having the following composition:

max. 0.03% carbon,
max. 0.03% nitrogen,
max. 10 to 30% chromium,
max. 5.0% nickel,
max. 3.0% copper,
max. 1.0% silicon,
max. 2.0% manganese,
0.5 to 4.0% molybdenum
and a carbon and nitrogen-binding agent, wherein the contents of this agent must correspond at least to the stoichiometric ratio which is necessary for the formation of nitrides and carbides, the remainder iron, said powder having been formed by atomizing a melt of said composition under argon, said steel produced by pressing and agglomerating said powder, and working this pressed and agglomerated powder by hot or cold working into a substantially dense and pore-free semi-finished product.

2. A chrome steel according to claim 1, wherein said carbon and nitrogen binding agent is at least one of the group consisting of titanium, niobium, tantalum and aluminum.

3. A chrome steel according to claim 1, wherein said carbon and nitrogen binding agent is titanium.

4. A ferritic chrome steel of claim 1, wherein the powder has a maximum of 0.5% nickel.

5. A ferritic chrome steel of claim 1, wherein the powder has a maximum of 0.2% copper.

6. A ferritic chrome steel of claim 1, wherein said semi-finished product is a sheet.

7. A method of producing semi-finished products in the from of sheets by a powder metallurgical technique from stabilized ferritic chrome steels, which are distinguished by being fine grained and having in the welded state high notched bar impace strength and low transition temperature, comprising atomizing melts of the chrome steels under argon to produce a powder having the following composition:

max. 0.03% carbon,
max. 0.03% nitrogen,
10 to 30% chromium,
max. 5.0% nickel,
max. 3.0% copper,
max. 1.0% silicon,
max. 2.0% manganese,
0.5 to 4.0% molybdenum
and a carbon and nitrogen-binding agent, wherein the contents of this agent must correspond at least to the stoichiometric ratio which is necessary for the formation of nitrides and carbides,
the remainder iron, pressing and agglomerating said powder, and working this pressed and agglomerated powder by hot or cold working into substantially dense and pore-free semi-finished product form.

8. A method of producing semi-finished products according to claim 7, wherein said chrome steel has a maximum of 0.5% nickel.

9. A method of producing semi-finished products according to claim 7, wherein said chrome steel has a maximum of 0.2% copper.

10. A method of producing semi-finished products according to claim 7, wherein said carbon and nitrogen-binding agent is at least one of the group consisting of titanium, niobium, tantalum, and aluminum.

11. A method of producing semi-finished products according to claim 7, wherein said carbon and nitrogen binding agent is titanium.

12. A method of producing semi-finished products by a powder metallurgical technique from stabilized ferritic chrome steels, which are distinguished by being fine grained and having in the welded state high notched bar impact strength and low transition temperature, comprising atomizing melts of a chrome steel of the composition:

0.03% carbon,
17% chromium,
2.4% molybdenum,
0.6% titanium,
0.03% nitrogen,
0.02% oxygen,
the remainder iron, pressing and agglomerating said powder, and working this pressed and agglomerated powder by hot or cold working into the substantially dense and pore-free semi-finished product form.

13. A method of producing semi-finished products according to claim 12, wherein said semi-finished product form is a sheet.

* * * * *